United States Patent [19]

Stoppazzini

[11] Patent Number: 4,534,186

[45] Date of Patent: Aug. 13, 1985

[54] ELECTROMECHANICAL DEVICE FOR SELECTING THE METAL STRAPS THAT CARRY INTO OPERATION THE NEEDLES OF AN AUTOMATIC STRAIGHT BAR KNITTING MACHINE

[75] Inventor: Benito Stoppazzini, Sala Bolognese, Italy

[73] Assignee: E.M.M. s.r.l. Emiliana Macchine Maglierie, Bologna, Italy

[21] Appl. No.: 590,737

[22] Filed: Mar. 19, 1984

[51] Int. Cl.[3] ..... D04B 7/00; D04B 15/66

[52] U.S. Cl. ..... 66/75.2

[58] Field of Search ..... 66/75.2, 78

[56] References Cited

U.S. PATENT DOCUMENTS

| | | | |
|---|---|---|---|
| 2,173,488 | 9/1939 | Tandler et al. | 66/75.2 |
| 3,693,377 | 9/1972 | Hadam | 66/75.2 |
| 4,030,319 | 6/1977 | Gloeckler | 66/75.2 |
| 4,281,523 | 8/1981 | Schimko | 66/75.2 |
| 4,429,553 | 2/1984 | Frund et al. | 66/75.2 |

*Primary Examiner*—Ronald Feldbaum

*Attorney, Agent, or Firm*—Stevens, Davis, Miller & Mosher

[57] ABSTRACT

The device comprises an electromagnet to the movable armature of which is integral a metal strap that supports, cantilever fashion, a shank provided with a plate. One part of the edge of the said plate is inserted in a slit machined in one extremity of a rod subjected to elastic means, guided in a way in which it slides, by a plate. The other extremity of the rod carries means for selecting a metal strap.

With the electromagnet de-energized, the selection means do not intercept a butt provided on the metal strap but with the electromagnet excited, the selection means intercept the said butt and this cause the said strap to be raised and subsequently sent into operation.

3 Claims, 3 Drawing Figures

ELECTROMECHANICAL DEVICE FOR SELECTING THE METAL STRAPS THAT CARRY INTO OPERATION THE NEEDLES OF AN AUTOMATIC STRAIGHT BAR KNITTING MACHINE

BACKGROUND OF THE INVENTION

The invention relates to a electromechanical device for selecting the metal straps that carry into operation the needles of an automatic straight bar knitting machine.

DESCRIPTION OF THE PRIOR ART

As is known, in automatic straight bar knitting machines each needle bed has in it equidistant slits in each of which, at the top, is inserted the needle provided metal strap, and at the bottom part there are, one following on after the other, two metal straps, the bottom one of which is destined to carry into operation, if selected, the corresponding needle.

The latter mentioned metal strap is provided with a butt low down and with another midway, and the second of these is destined to be intercepted by suitable selection means consequentially to the operation of these. The said interception causes a predetermined upward movement on the part of the metal strap, sufficient to position the lower butt in the path of a fixed cam provided in the carriage of the machine.

The interception of the said cam with the said lower butt brings about a further upward movement on the part of the said metal strap and the relevant needle consequently to be carried into operation.

With the recent utilisation of the electronic control units destined to establish a programmed machine cycle, some manufacturers of automatic straight bar knitting machines have employed, as selection means, armature type electromagnets.

The projection of the said armature from its housing causes directly, or indirectly with the interposition of suitable leverages, the interception of the butt half way along the corresponding metal strap destined to carry, since it has been selected, the corresponding needle into operation.

SUMMARY OF THE INVENTION

The object of the invention is to make available an electromechanical device destined, when energized, to select a corresponding metal strap for carrying a corresponding needle into operation, utilizing technical methods that clearly differ from the technical solutions known for fulfilling the same task, and to do so without in any way compromising the reliability and functional proficiency of the performance of the said device.

BRIEF DESCRIPTION OF THE DRAWINGS

The characteristics of the invention are made clear in the text that follows, with reference to one accompanying table of drawings, in which.

DESCRIPTION OF THE PREFERRED EMBODIMENT

Figure 1:
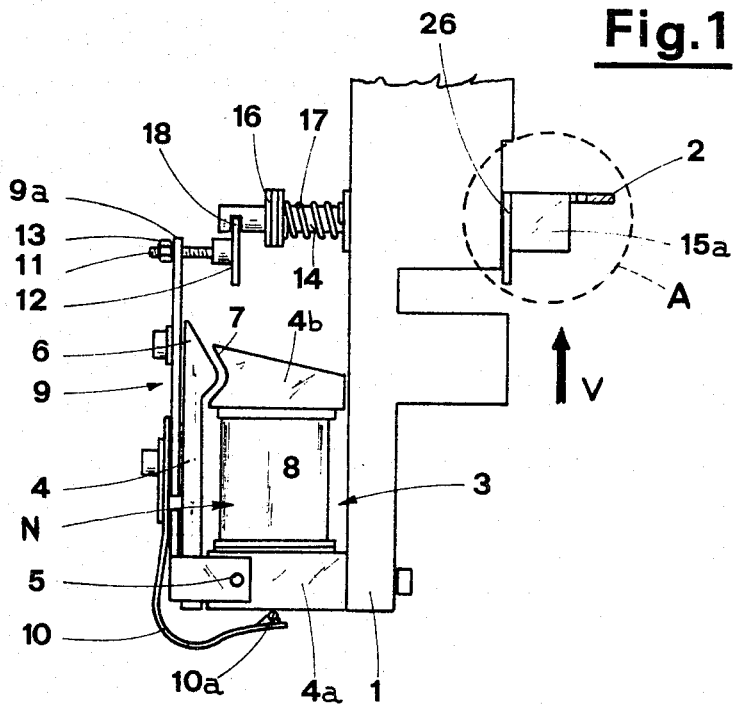
FIG. 1 shows, in a later view, the device in question.

With reference to FIG. 1, at 1 as been shown a plate locked to the (non illustrated) carriage of an automatic knitting machine, only the metal strap 2 of which has been shown.

The said plate is integral with an electromagnet 3, the armature 4 of which is pivotally connected at 5 to a cross piece 4*a* of the core of the electromagnet. The free extremity of the armature has in it, low down, a "V" shaped protruding part 6 destined to be inserted into a complementary housing 7 made in one extremity of the other cross piece 4*b*.

To the armature 4 is fixed, on the opposite side with respect to the coil 8 of the electromagnet, a blade 9 that projects beyond the protruding part 6. One extremity of a metal band 10 is locked to the said blade 9, the other extremity being flush up against a pin 10*a* integral with the cross piece 4*a*. The elastic reaction of the said band exerts on the armature 4 an effect in contrast with the magnetic force applied at length thereon as a consequence of the excitation of the coil 8.

Externally to the armature, the extremity 9*a* of the blade 9 has locked to it, in a removable fashion by means of screwing, a threaded shaft 11 provided with a plate 12 turned towards the cross piece 4*b*. The position of plate with respect to the metal strap, can be set by means of a nut 13 coupled to the shank 11.

At 14 has been shown a rod that passes freely across a through hole made in the plate 1. On one side of the latter the rod is provided with selection means 15 (that have an inclined surface 15*a*, more about which will be said hereinafter) and with a lateral locator member 26 that defines, by abutting with the underneath surface of the plate, the non-operative position I of the selection means 15.

In the part of the rod 14 situated, with respect to the plate, on the opposite side to the selection means 15, is locked a ring 16 that serves as a stop for a helical spring 17 (partially wound on to the rod) placed in between the said ring at the plate 1.

In the extreme part of the rod 14 situated way past the ring 16 there is a transverse slit 18 destined to accept freely part of the edge of the plate 12.

Figure 2:
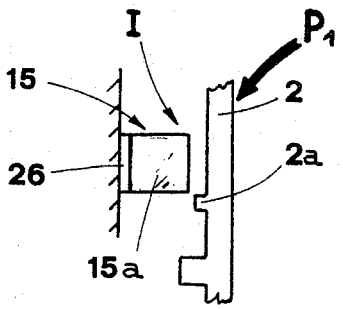
FIGS. 2 and 3 show, in the direction V, the detail A in FIG. 1 with the selection means in the non-operative and in the operative position, respectively.

With the coil 8 de-energized, the band 10, the spring 17 and the locator member 26 define the non-operative position of the selection means 15 (FIG. 2). The surface 15*a* of the said means, when in the said position, does not intercept the butt 2*a* of the metal-strap 2 during the movement of the carriage and thus the said strap is not selected (position $P_1$, FIG. 2).

Figure 3:
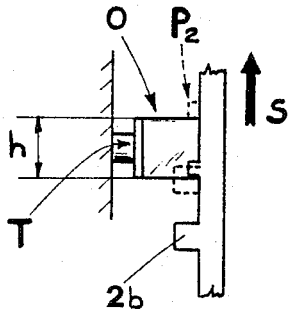

The excitation of the coil 8 brings about the rotation in the direction N of the armature 4, and the consequent movement in the direction T of the rod 14; this causes the operative position O for the selection means 15. In the said position, as a consequence of the carriage traversing, the surface 15*a* intercepts the butt 2*a* causing the movement (towards S) of the metal strap 2 for a distance equal to "h" (position $P_2$ shown in dotted lines in FIG. 3).

The said movement of the metal strap positions a butt 2*b* (below 2*a*) along the path of a fixed cam provided on the carriage (not illustrated since of a known type), the interception of which against the said butt 2*b* causes a further movement of the metal strap 2 in direction S, thereby bringing about, as is known, the despatch into operation of the needle with which the said metal strap is provided.

Obviously the coil 8 stays excited for sufficiently long a period to select the metal strap 2 (that is to say, to displace the metal strap for an "h" distance). When the coil 8 is de-energized, the device in question returns to the original condition (namely the inoperative position for the selection means 15).

It is understood that the foregoing description has been given purely as a unlimited example and thus that eventual variants in the constructional details can all be taken as falling within the framework of the technical solution seen above and claimed hereinafter.

What is claimed is:

1. Electromechanical device for selecting the metal straps that carry into operation the needles of an automatic straight bar knitting machine, each of the said metal straps being provided with at least two butts, one of which positioned in the lower part and the other centrally, the latter being destined, when intercepted by selection means, to cause the metal strap concerned to undergo a movement with the consequential positioning of the lower butt in the path of a fixed cam provided in the carriage of the machine, the interception of which against the said lower butt causes a further movement, in the same direction as before, of the said metal strap and the carrying into operation of the relevant needle; the said device being characterized by the fact that it comprises: an electromagnet locked to a plate provided in the said carriage, the armature of which is pivotally connected to the magnetic core; first elastic means exerting on the said armature an effect in contrast with the magnetic force applied at length thereon; a blade locked to the said armature and projecting there from; a cylindrical element locked perpendicularly to the part of the said blade that protrudes from the armature, and provided at the bottom end with a plate; a rod that passes freely across a hole drilled in the said plate, provided on one side of the latter with means for selecting a corresponding metal strap, as well as with a transverse locator member that defines when abutting with the said plate, the non-operative position of the said selection means, and on the opposite side of the plate with respect to the said selection means, with a transverse slit destined to accept one part of the edge of the said plate; and second elastic means that act on the said rod in contrast with the action exerted on the latter by the said plate in consequence of the excitation of the coil of the electromagnet.

2. Device according to claim 1, wherein the said cylindrical element takes the form of a threaded shank that screw engages with the said blade and with a nut, the latter destined to regulate constantly the distance separating the plate 12 from the said blade.

3. Device according to claim 1, wherein the said second elastic means take the form of a helical spring partially wound around the said rod and interposed between the said plate and a collar locked to the said rod.

* * * * *